United States Patent [19]

Gironda, Jr.

[11] 4,162,9

[45] Jul. 31, 19

[54] ARCHAEOLOGICAL SIFTING BASKET

[76] Inventor: Ralph F. Gironda, Jr., 147 Webster Ave., New Rochelle, N.Y. 10801

[21] Appl. No.: 860,553

[22] Filed: Dec. 14, 1977

[51] Int. Cl.[2] ..... B07B 1/02

[52] U.S. Cl. ..... 209/235; 209/417; 209/414

[58] Field of Search ..... 209/418–420, 209/412–414, 417, 235, 236, 374, 375, 376, 253–254, 243, 352, 353, 354; 37/118 R, 119; 43/55, 60, 61; D9/242, 246, 247, 248; D87/1 R; 220/19; 73/423 A; 141/286

[56] References Cited

U.S. PATENT DOCUMENTS

| | | | |
|---|---|---|---|
| 277,278 | 5/1883 | Henninger | 209/417 |
| 660,994 | 10/1900 | Mastin | 48 |
| 725,172 | 4/1903 | Taylor | 209/ |
| 2,545,226 | 3/1951 | Claude | 209/ |
| 2,642,836 | 6/1953 | Brooks | 43 |
| 2,793,788 | 5/1951 | Lysne | 220 |
| 4,000,577 | 1/1977 | Kelley | 43 |

*Primary Examiner*—Robert Halper
*Assistant Examiner*—Jon Hokanson
*Attorney, Agent, or Firm*—Pennie & Edmonds

[57] ABSTRACT

An archaeological sifting basket is disclosed for use the site of an archaeological dig, said basket compris a frame, with wire mesh screen attached. The baske hinged to be collapsible and has a bottom wall made of two planar areas arranged at an angle to each ot for increased flexibility of use.

12 Claims, 9 Drawing Figures

FIG.6
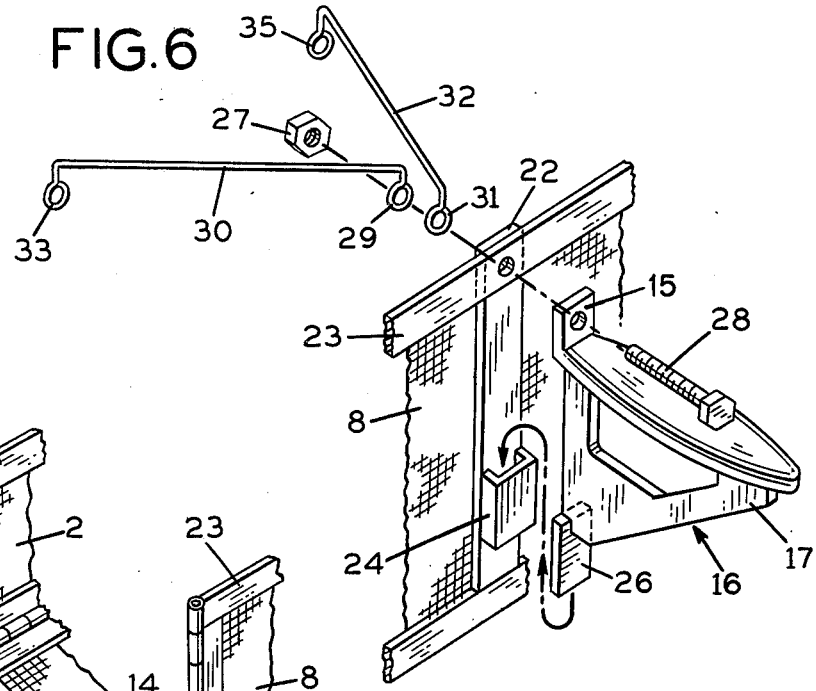
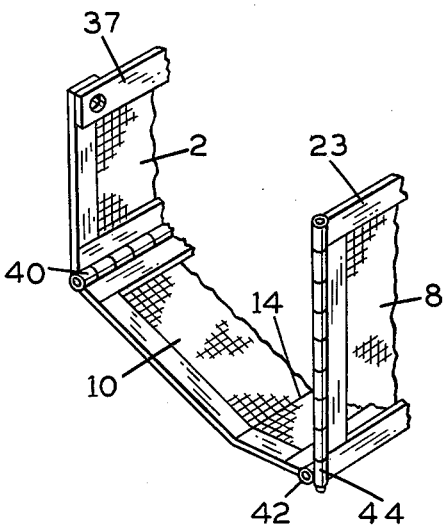
FIG.7
FIG.8
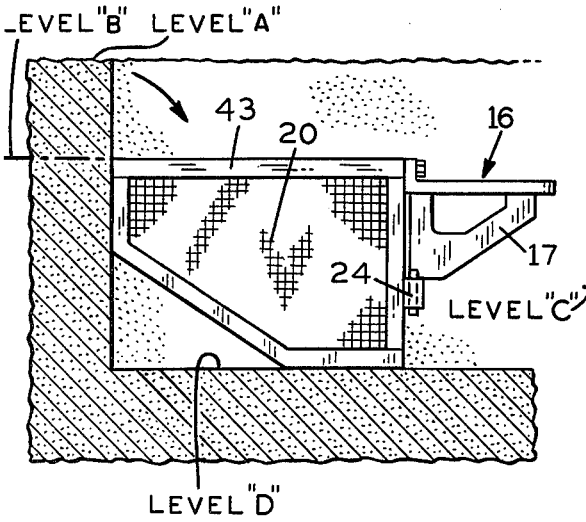
FIG.9
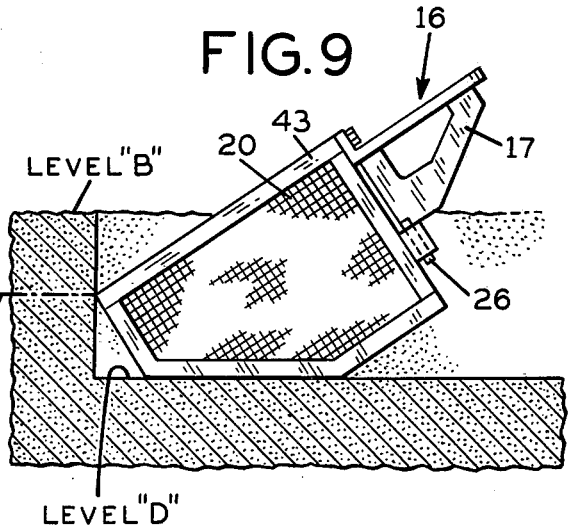

ARCHAEOLOGICAL SIFTING BASKET

BACKGROUND OF THE INVENTION

1. Field of Invention

The basic unit of archaeological exploration is the site, which has been defined as "any location which exhibits evidence of past human activity." The definition is purposefully vague so as to encompass every conceivable area which may prove useful to research, from a campsite which may contain only a few artifacts to a city of several hundred thousand people.

Sites are located by their unique characteristics, stone tools, or pottery fragments lying on the surface, vegetation differing from the immediately surrounding area which indicates that the site may have been cleared in prehistoric times, or suspicious looking mounds or depressions of regular form, which may have been manmade. Sites may also be located by exploration of areas which experience has indicated were most frequently occupied, river forks, the edge of a bluff overlooking a river valley, or a natural stone formation providing shelter.

Once the site is located, the archaeologist normally makes out a survey form, systematically recording the location of the site on a map and describing its features. Normally, the site is photographed and a sketch map drawn. The site is given a number for identification, which is used on all notes or materials obtained.

After all the sites in an area have been surveyed and the survey notes reviewed in detail, the archaeologist determines which sites to excavate, based on his own particular interests and the reason for his research.

A major purpose of excavation is to determine the specific location of individual objects recovered from the site. Horizontal location may indicate that certain areas of a site were set aside for tool making, cooking, or keeping or slaughtering animals. By knowing the exact horizontal location of objects received, the plan of a camp or village may be reconstructed and much insight as to the lifestyle of the inhabitants is provided. Vertical placement or stratigraphy, may indicate the presence of several different groups of people living on a given site at different times.

Horizontal placement is normally determined by use of a grid system of N-S, E-W lines dividing the surface of the site into a pattern of squares of equal area. The site is then sampled to determine the most desirable squares for excavating. A common method of sampling is digging test trenches at right angles to one another in an X, L or T shape. Squares determined to be most likely to be productive are then excavated one or one/-half at a time.

Vertical placement is normally measured from the surface or from an arbitrary datum level. Each object located is carefully recorded, along with its horizontal and vertical placement.

2. Prior Art

Actual excavation is frequently done by means of a trowel or scoop. Earth is transferred to a bucket and then to a sifter for the recovery of artifacts.

Conventional archaeological sifting devices comprise a wooden frame forming shallow box structure having wire mesh attached as a floor. The frame is normally of such dimension and weight as to require that it be supported on legs and spaced at some distance from the dig site. This arrangment requires the archaeologist to transport buckets of earth from the dig site to the sifter, utilize the sifter, and return to the dig site for mor earth.

The conventional sifter has disadvantages in that tim and energy are expended in continually transportin earth to the sifter, waiting for others to finish using th sifter, and returning to the dig site.

In addition, as explained, an accurate determinatio of the placement of objects located is essential to th research of an archaeologist. Accurate placement i extremely difficult to determine when earth is sifted i large quantities as it tends to be when the sifter is som distance away. Disposal of waste material which accu mulates beneath the conventional sifter is yet anothe disadvatage. The sifter must be positioned prior to com mencement of excavation. During excavation, how ever, archaeologists may discover, from the artifact found, that there is need for further exploration pre cisely in the area occupied by the sifter.

The article PARTIAL RECOVERY, AND SAM PLE BIAS: THE RESULTS OF SOME SIEVINC EXPERIMENTS, by Sebastian Payne, taken from th book *Papers In Economic Prehistory,* E. S. Higgs, Cam bridge University Press, describes several alternative to the conventional sifter described above.

One of these is the throwscreen, a mesh, set nearl upright, against which the earth is thrown. Larger parti cles roll down the near side to the ground and ar searched through. The throwscreen is commonly use but is generally considered inefficient and difficult t work with.

Common hand-held sieves are soemwhat better, bu have the disadvantages of mesh size not being specifi cally adapted to archaeological work, having sides to high for objects to be easily located and picked out an being of insufficient volume for fast and efficient work Finally, there are sieves designed especially for archae ological work. These must be custom built and ar costly in terms of both time and money.

One such design comprises a stack of shallow-bo like sieves resting on a roughly cubicle frame which i stationary and rests on the ground. It is not dissimilar t the conventional sifter described above except for it more permanent construction and the fact that it con sists of a stack of sieves rather than a single sieve.

BRIEF SUMMARY OF THE INVENTION

The invention comprises an archaeological siftin basket, in which a frame defines four walls and a bottor wall, the bottom wall having a front and rear plana area arranged at an angle to each other. The frame als defines an open top. The frame may be of lightweigh metal strap, plastic or any other durable material, hav ing wire mesh screen attached thereto, providing max mum sifting area. At certain of the intersections of th side walls with the front, back and bottom walls, hinge are provided and at the remaining intersection the adj cent walls may be separated so that the basket may b folded into a compact unit with all separate pieces cor tained within the interior of the folded basket for eas transport in a knapsack or other container to various di sites in the field. The basket includes a removable har dle comprising an extended gripping portion and a pe pendicular brace, said brace having an opening adjace the gripping portion so that the handle may be grippe with one hand. The basket may be utilized at the dig si leaving one hand free for brushing earth and other ma ter into the basket, and one or both hands may then b d to agitate the basket causing small particles to filter , into a bucket, bag or other container, and leaving ger particles in the basket.

The bottom of the basket has two planar areas posi- ied at an angle to one another. The rear planar area f such an extent as to support the basket in a stable dition in a first position with the opening of said ket substantially horizontal. The front planar area of bottom is of an extent sufficient to support the bas- in a stable condition in a second position with the ning of said basket positioned in a plane at an angle he horizontal. This enables the basket to be tilted vard to rest upon said front planar area of the bot- , thus lowering the upper front edge of the basket h respect to the horizontal surface of the dig area ig worked. This, in turn, enables the continued use- ess of the basket after the horizontal surface being ked is lowered to the upper edge of the basket when aid first position, without the necessity of digging n to a lower plane on which to rest the basket. It is necessary to tip the basket to its second position for archaeologist to continue working the same hori- tal surface.

BRIEF DESCRIPTION OF THE DRAWING he construction and operation of the invention both s preferred embodiment and its general application be apparent to those skilled in the art, from the wing specification and drawing in which:

IG. 1 is a perspective view of the fully assembled et;

IG. 2 is a perspective view of the fully collapsed et;

IG. 3 is a perspective view of the partially assem- basket;

IG. 4 is a horizontal cross-sectional view taken g line 4—4 of FIG. 1;

IG. 5 is a cross-sectional view taken along line 5—5 IG. 2;

IG. 6 is an exploded perspective view, showing a ion of the rear of the basket prior to securing the lle and support members to the basket;

IG. 7 is a perspective view of the rear, bottom and t walls of the basket, similar to FIG. 1, showing the ntion as modified by alternative placement of the m hinge;

IG. 8 is a somewhat schematic side elevational rep- ntation of the basket in use in its upright position at site; and IG. 9 is a somewhat schematic side elevational rep- ntation of the basket in use in its forward position at site.

DETAILED DESCRIPTION OF THE INVENTION

Figure 1:
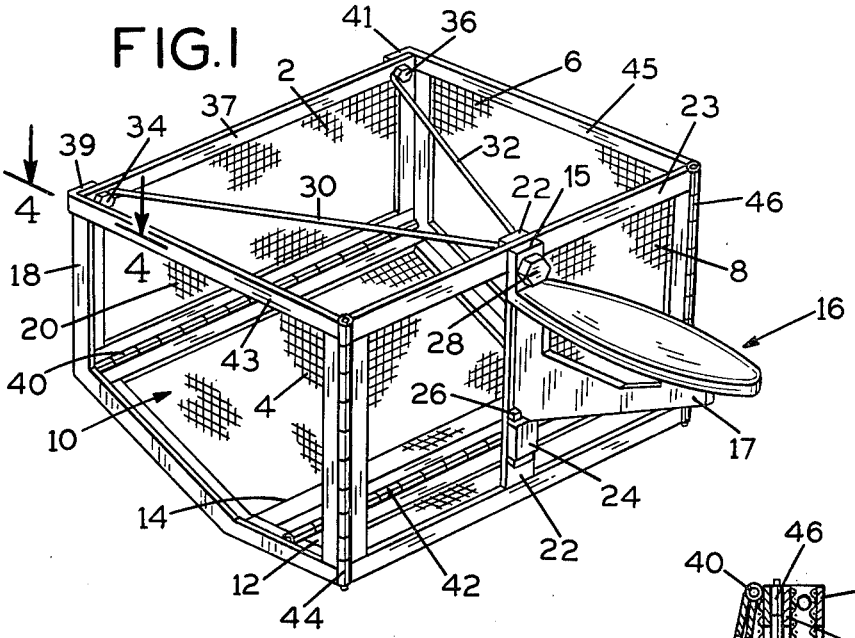

G. 1 represents the fully assembled archaeological g basket having four generally upright walls, a wall 2, side walls 4 and 6, and a back wall 8. The et also has a bottom wall having front and rear ar areas 10 and 12, respectively, meeting along a 14, and arranged at an angle hereinafter explained. ch of the walls 2, 4, 6 and 8 and the bottom wall ar areas 10 and 12 are made up of a frame to which ured wire screen mesh. For example, the left side 4 has a frame 18, with screen mesh 20. The remain- walls and the bottom sections are constructed in rally the same manner.

The rear wall 8 has an additional frame member 22, which supports a handle 16, having a downwardly extending brace 17, including a tongue 26 removably engaged in a U shaped channel 24 welded to frame member 22.

The handle 16 is also attached to the additional rear frame member 22 by means of a bolt 28 passing through an upwardly extending portion 15 of the handle 16, the frame members 22 and 23 secured by a nut 27 (See FIG. 6). The bolt 28 also passes through eyes 29, 31 on tension members 30 and 32, respectively.

Figure 4:
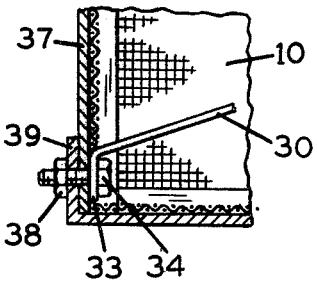

The tension members 30 and 32 have eyes 33, 35, respectively, at their forward ends through which bolts 34 and 36, respectively, pass. The bolts 34, 36 also pass through front frame member 37 and bent over ends 39, 41, respectively, of side frames 43, 45, respectively. Suitable nuts are then threaded on the bolts 34, 36 only the nut 38 for bolt 34 being shown (See FIG. 4).

Hinge members, which may be piano hinges as shown, or any other suitable equivalent structure, are provided at 40, 42, 44 and 46 as shown so that, after removal of handle 16 tension members 30 amd 32 and bolts 34, 36, 38 the basket may be folded for transport. Hinge 40 allows front wall 2 to be folded downwardly toward and to lie against the front bottom section 10. The bottom front planar area 10 and the forward portion of bottom rear planar area 12 are then folded upward about hinge 42 until hinge 40 bears against the upper edge of the rear wall 8. Side wall 4 is then rotated about the axis of hinge 44 so that side wall 4 lies against rear wall 8. Then side wall 6 is rotated about the axis of hinge 46 to lie against side wall 4.

Figure 2:
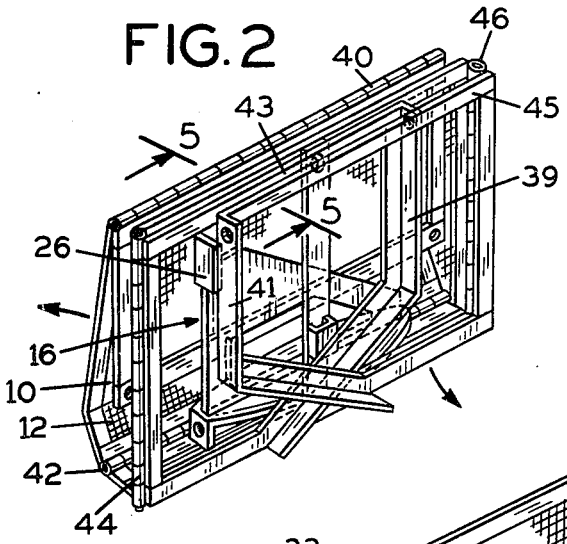
Figure 5:
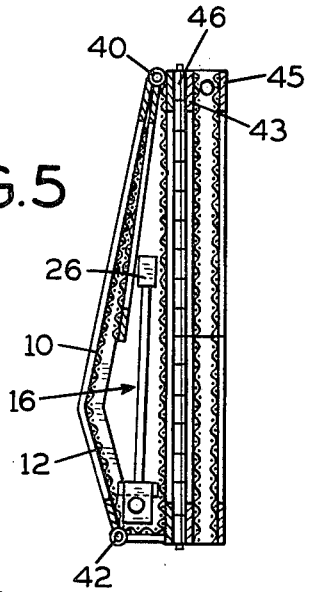

The completely folded basket is illustrated at FIGS. 2 and 5, which also illustrate placement of the handle 16 in the interior cavity formed by the angle at which bottom planar area 10 and 12 meet.

Figure 3:
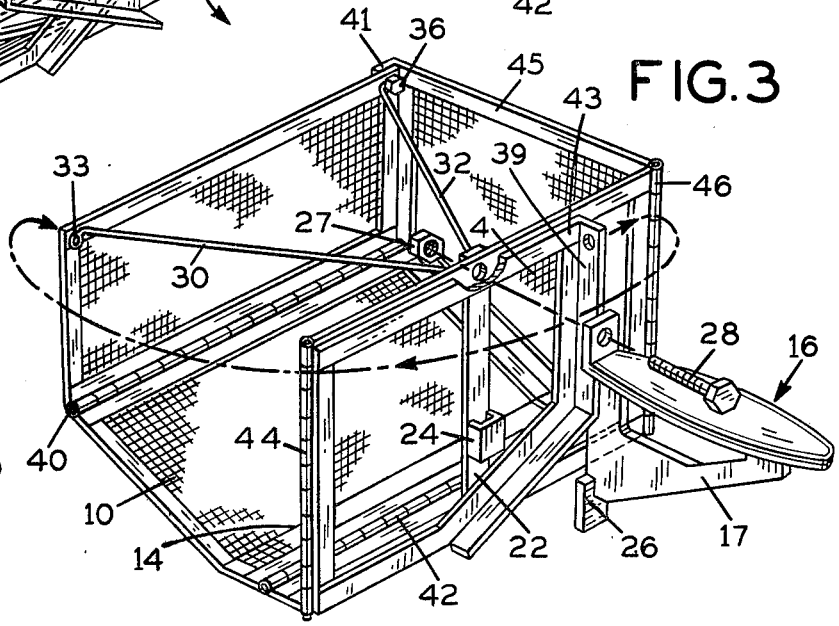

FIG. 3 illustrates the partially assembled basket. The left side wall 4 has yet to be rotated about the axis of hinge 44 and secured to front wall 2 and tension member 30 by nut 38 and bolt 34. In FIG. 3 a section from the top of side wall 4 has been cut away so that attachment of the handle 16 (after assembly of side wall 4 to the front wall 2 or above described) can be illustrated.

FIG. 7 illustrates an alternative placement of hinge 42 so that it is at the rearward edge of planar area 12.

FIGS. 8 and 9 illustrate one example of the basket's application in the field. In the course of excavation, there are several different horizontal levels of digging at any one time, because squares are dug at differing rates. FIG. 8 illustrates the basket in the upright position on one such level D, i.e. the floor of a trench of square or a shelf within a trench. Earth is taken from level A and brushed or scooped into the basket, the basket is then lifted and agitated over a pail, plastic bag or other receptacle for later removal from the site. This process may be repeated numerous times between levels A and B if the archaeologist seeks great accuracy in location of objects. If great accuracy is not required, the archaeologist may go from levels A to B or even from A to C with only one sifting.

One advantage of the invention is that it allows earth to be sifted in any amount from a spoonful to an entire basket full, depending on the degree of accuracy required and the delicacy of the work. Another advantage is that sifted earth from the excavation site, which is waste material, may be removed by assistants, rather than by the archaeologist, that it may be transported to any area, and that, if plastic bags are used, it may even be moved from one place to another if further excavation is required.

The angle in the bottom wall of the basket between planar areas 10 and 12 serves a dual function. First it allows the front edge of th basket to be lowered, as illustrated in FIG. 9 so that after the archaeologist has moved the material between level A and level B (FIG. 8) he may tilt the basket to go from level B to level C (FIG. 9).

Secondly, tilting the basket forward raises the rear wall of the basket providing a surface which deflects earth down into the basket. This is particularly valuable when the archaeologist is working a flat surface. Rather that lifting a scoopful of earth at a time and placing it in the basket, he may flick or brush earth toward the basket. The rear wall prevents the material from flying over the rear of the basket by deflecting it so that it falls down inside the basket.

The included angle between the forward and rear planar areas 10, 12 of the bottom may be any angle greater than 90° and less 180°; however, an angle of between 120° and 160° has been found more useful with an angle of from above 140° to about 150° being presently preferred.

Important to the strength of the basket while insuring light weight are the tension members 30, 32. They need be only very small in cross section and may be wire, chain or the like, yet since any weight in the basket acts upon them to tension them they impart considerable strength to the basket, particularly the front.

What is claimed is:

1. A method of excavating an archaeological site having a plurality of levels by using an archaeological sifting basket having a bottom wall which bottom wall has a front and rear planar area arranged at an angle to each other comprising placing said archaeological basket on a relatively lower level with said basket resting stably upon said rear planar area, brushing material to be sifted from a relatively higher area into said basket thereby lowering the said relatively upper level to an intermediate level above said relatively lower level, subsequently resting said archaeological sifting basket on said relatively lower level with said basket resting upon said front planar area, brushing material to be sifted from said intermediate level into said basket, and sifting the material brushed into said basket.

2. The method of claim 1 in which said basket when resting on said front planar area presents an open top disposed at an angle to the horizontal.

3. An archaeological sifting basket comprising a frame with wire mesh screen attached; said frame defining the peripheries of a front wall, a back wall, a first and second side wall, an open top and a bottom wall; said bottom wall including wire mesh screen; said bottom wall having a front and a rear planar area arranged at an included angle of between 90° and 180° to each other; said rear planar area being disposed at an angl said back wall; said front planar area being positione an angle to said front wall; said rear planar area bein such an extent as to support said basket in a stable co tion in a first position with the open top of said ba substantially horizontal when said basket is rested u said rear planar area on a substantially horizontal p tion of a dig; and said front planar area being of suc extent as to support said basket in a stable conditio a second position on a substantially horizontal por of a dig with the open top of said basket being p tioned in a plane at an angle to the horizontal.

4. The article of claim 3, including means, other t the said first and second side walls, extending betw said back and front walls adjacent the open top of s basket for strengthening said basket, said means be under tension during the use of said basket.

5. The article of claim 4, including a handle, me for removably attaching said handle to said bas including said attaching means including means securing said tension support means to the said b wall of said basket.

6. The article of claim 3 including hinge means permitting said basket to be folded for transport.

7. The article of claim 6, in which said back wall said front wall are substantially parallel and meet s side walls and said bottom wall to define corners the with, and said hinge means including a hinge unit p tioned at least at one of said corners for providing p otal relationships between adjacent walls.

8. The article of claim 7 including said hinge being at the intersection of said rear planar area w said back wall.

9. The article of claim 7, including said hinge me including a second hinge unit positioned along a l dividing said rear planar area and parallel to the in section between said rear planar area and said fr planar area.

10. The article of clam 9, including a handle, s handle including a gripping portion extending c wardly from said back wall, a brace extending fr such extended portion to said back wall, said extend portion being free about its periphery to provide gripping of the extended portion by at least one hand the user.

11. The article of claim 10 in which said brace i substantially triangular member and in which said angular member has an opening through which fingers of at least one hand may fit for gripping the s outwardly extending portion of said handle.

12. The article of claim 10 in which said handle removable from said basket and is positionable wit the folded basket in space in part defined by the fr and rear planar areas.

* * * * *

UNITED STATES PATENT AND TRADEMARK OFFICE

CERTIFICATE OF CORRECTION

PATENT NO. : 4,162,967

DATED : July 31, 1979

INVENTOR(S) : Ralph F. Gironda, Jr.

It is certified that error appears in the above-identified patent and that said Letters Patent are hereby corrected as shown below:

Column 1, line 63, "forming shallow box structure" should read --forming a shallow box structure--.

Column 2, line 14, "disadvatage" should read --disadvantage--.

Column 2, line 32, "soemwhat" should read --somewhat--.

Column 4, line 22, "30 amd 32" should read --30 and 32--.

Column 4, line 51, "trench of square" should read --trench or square--.

Column 5, line 5, "of th basket" should read --of the basket--.

Column 5, line 14, "Rather that" should read --Rather than--.

Column 5, line 21, "less 180°" should read --less than 180°--.

Column 6, line 40, "Clam 9, including a" should read --Claim 9, having a--.

Signed and Sealed this

*Twentieth* Day of *November 1979*

[SEAL]

*Attest:*

RUTH C. MASON
*Attesting Officer*

LUTRELLE F. PARKER
*Acting Commissioner of Patents and Trademarks*